United States Patent [19]

Uhlig

[11] 4,147,278

[45] Apr. 3, 1979

[54] FLUID PRODUCT DISPENSER

[75] Inventor: Albert R. Uhlig, Toledo, Ohio

[73] Assignee: Owens-Illinois, Inc., Toledo, Ohio

[21] Appl. No.: 785,324

[22] Filed: Apr. 7, 1977

Related U.S. Application Data

[62] Division of Ser. No. 588,751, Jun. 20, 1975.

[51] Int. Cl.[2] ..... B65D 83/14; B65D 35/28

[52] U.S. Cl. ..... 222/94; 222/95; 222/400.8

[58] Field of Search ..... 222/209, 386.5, 95, 222/94, 401, 179, 496, 400.5, 400.7, 400.8

[56] References Cited

U.S. PATENT DOCUMENTS

| | | | |
|---|---|---|---|
| 2,342,490 | 2/1944 | Janke | 222/209 |
| 2,665,825 | 1/1954 | Poitras et al. | 222/209 |
| 2,709,542 | 5/1955 | Eller et al. | 222/209 |
| 2,710,711 | 6/1955 | Hutton | 222/400.8 |
| 3,223,289 | 12/1965 | Bouet | 222/209 |
| 3,342,377 | 9/1967 | Peredy | 222/386.5 X |
| 3,592,365 | 7/1971 | Schwartzman | 222/209 X |

*Primary Examiner*—John P. Shannon
*Attorney, Agent, or Firm*—Charles S. Lynch; M. E. Click; D. H. Wilson

[57] ABSTRACT

The disclosure is directed to a fluid product dispenser. The dispenser includes first and second containers. The second container is positioned within the first container. The product is placed in one of the containers and a dispensing nozzle or opening is in communication with the product. The second container has a flexible wall adjacent the product. Fluid is introduced into the other container. A force is applied to the flexible wall to urge the product outwardly through the dispensing nozzle or opening.

4 Claims, 16 Drawing Figures

FLUID PRODUCT DISPENSER

This is a division, of application Ser. No. 588,751, filed June 20, 1975.

BACKGROUND OF THE INVENTION

Many attempts have been made in the prior art to provide product dispensers. One problem found in the prior art was that of "suck-back" wherein a portion of a partially dispensed product and also air is drawn inwardly into a product reservoir after the product dispenser has been operated. This often occurs, for example, where a prior art flexible walled container is used. After the flexible walled container has been squeezed to dispense the product, and then released, the return of the container to its memory position lowers the pressure within the container thereby drawing air and partially dispensed product back into the container. This problem is particularly pertinent where the product is damaged by oxidation and also where sterile products are important, for example, in hospitals.

Another problem found in many prior art dispensers is that it is often difficult in such dispensers to empty the product completely without relatively sophisticated dispensing equipment.

Still another problem found in many prior art dispensers is that the dispensers may only be utilized in certain positions. For example, if one uses a dispenser which relies primarily upon gravity, it is extremely difficult to use the dispenser in an upright position, while on the other hand, if an aerosol dispenser is utilized, in some positions it is possible to dispense the carrier fluid and not the desired product.

Many rather sophisticated prior art dispensers have been designed to attempt to solve one or more of the above problems. If the cost of the dispenser structure is too high, it becomes imperative to re-use such structure. On the other hand, many prior art throw-away dispensers create an additional ecology problem of garbage or trash disposal.

Roth U.S. Pat. No. 3,289,949 discloses the use of an inner cartridge which is pressurized. The product is dispensed by a venturi principle.

U.S. Pat. No. 3,876,115 is directed to a double expansible bladder container having two expansive bladders coextensive with one another. This dispenser relies upon the high-elastic memory material of the second bladder to dispense product from the coextensive first bladder.

SUMMARY OF THE INVENTION

The present invention provides a product dispenser in which the contents may be fully emptied from the dispenser. Furthermore, air or fluid "suck-back" is virtually eliminated thereby making it possible to use the dispenser in connection with products which are subject to oxidation.

In some of the following embodiments, an inexpensive flexible bag is utilized to hold the product. After the product is dispensed, the inner bag may be easily disposed of and replaced. Several embodiments of the present invention are very useful in the fields of sterile packaging and also have ecology advantages.

A product dispensing means is provided in communication with either an inner or outer container which contains the product. At least one of the inner and outer containers includes a flexible wall adjacent the product. A fluid is introduced into a chamber defined by the other container. A force is then transmitted to the flexible wall which urges the product outwardly through the product dispensing apparatus.

DESCRIPTION OF THE PREFERRED EMBODIMENTS

Figure 1:
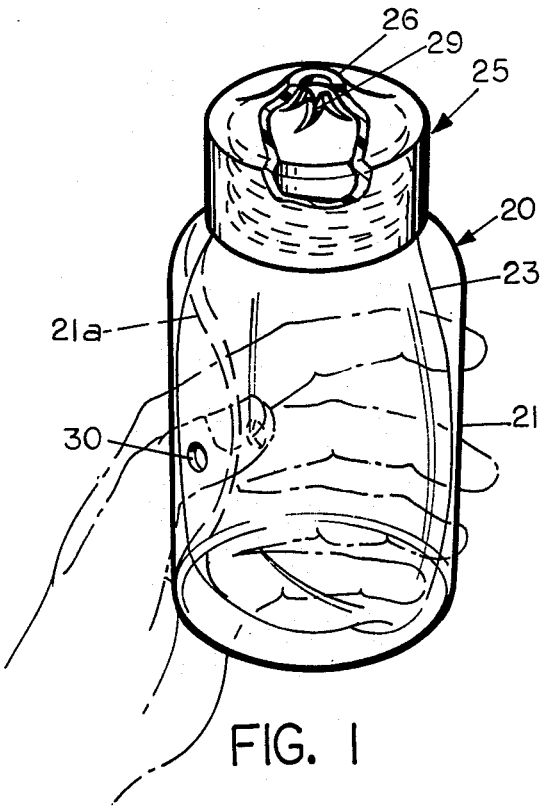
FIG. 1 is a perspective view of a fluid product dispenser, according to the present invention, and showing a dashed line position indicating the position of dispenser components as product is being dispensed.
Figure 2:
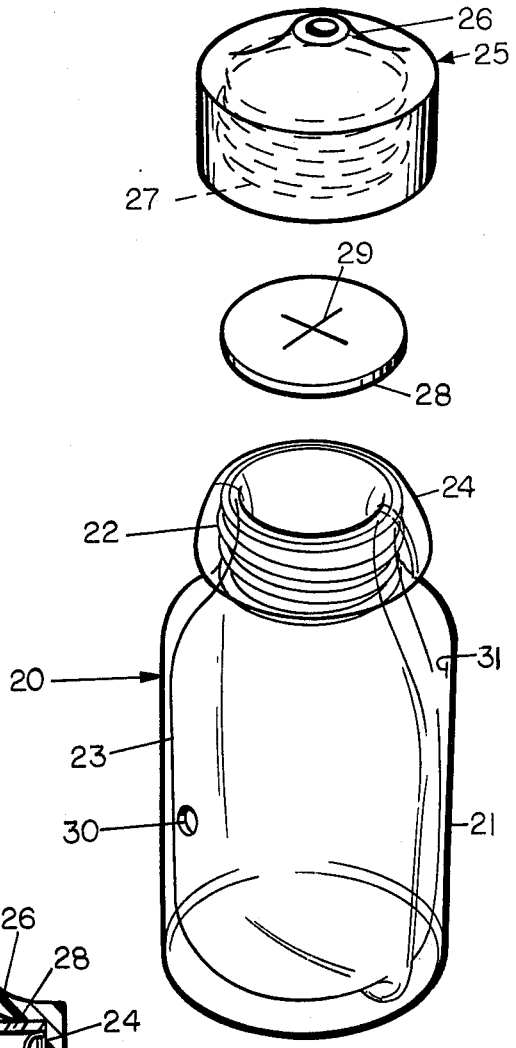
FIG. 2 is an exploded view of the FIG. 1 embodiment.
Figure 3:
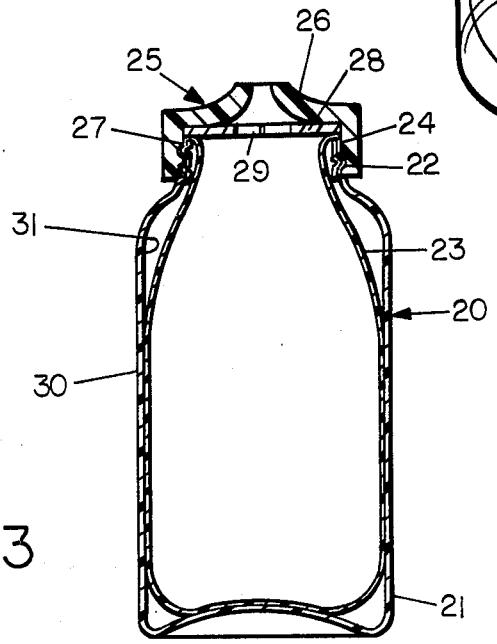
FIG. 3 is a vertical cross-sectional view of the embodiment shown in FIG. 1.
Figure 4:
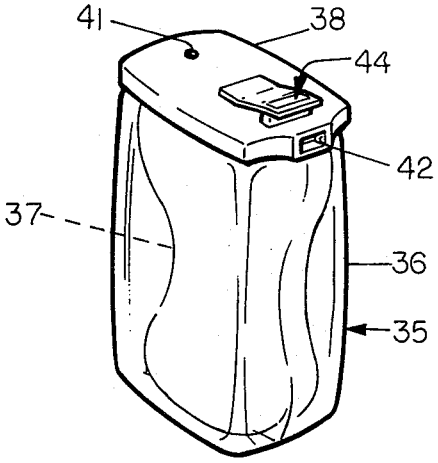
FIG. 4 is a perspective view of a second embodiment of a fluid product dispenser, according to the present invention.

Referring to FIGS. 1–3, a fluid product dispenser, according to the present invention, is generally indicated by the reference number 20. The dispenser 20 includes an outer container 21 having a threaded neck 22. An inner container 23 comprising a generally flat, flexible plastic bag, has an upper end 24 supported by the neck 22. A cap assembly 25 includes a dispensing nozzle 26. The inner portion of the cap assembly 25 includes mating threads 27, as indicated in FIG. 2. A rubber valve gasket 28 having a dispensing passageway 29 is positioned within the cap assembly 25. When the cap assembly 25 is mounted on the outer container 21, as shown in FIGS. 1 and 3, both the flexible bag 23 and valve gasket 28 are held in an assembled relationship.

In the present embodiment, the outer container 21 is constructed of a flexible material and defines a side opening 30 in its flexible sidewall.

Many shapes, sizes and types of material may be used in constructing the outer container 21, the inner container or flexible bag 23 and the cap assembly 25. In the present embodiment, the cap assembly 25 is constructed of a rigid plastic material. The outer container 21 is constructed of a flexible plastic material that may be deformed as indicated by the squeezed position 21*a*, indicated in FIG. 1. The flexible bag 23 is constructed of blown plastic film which is formed into rolls. Individual bags 23 are defined and separated by individual perforations or tear strips (not shown), as is well known in the art.

The product is placed within the inner container or flexible bag 23. Many types of products may be dispensed using the fluid product dispenser 20. For examples, all types of fluid materials including liquids, creams and even materials having a molasses-like consistency may be placed in the flexible bag 23. It has been found that so long as the material is somewhat viscous in nature, as opposed to a non-viscous fluent material such as sand, it may be dispensed from the fluid product dispenser 20.

The outer container 21 and the inner container or flexible bag 23 define therebetween a pressure chamber, generally indicated by the reference number 31. The opening 30 serves as a fluid passageway to admit air at atmospheric pressures into the pressure chamber 31. To dispense the product, a finger or thumb (see FIG. 1) is placed over the opening 30 to close the fluid passageway. Squeezing of the flexible outer container 21 transmits a generally uniform force upon the flexible bag 23, thus compressing the bag 23 and dispensing the product from the flexible bag 23 outwardly through the valve gasket 28 and the dispensing nozzle 26. When the thumb is removed from the opening 30 and the manual pressure on the outer container 21 released, additional atmospheric air is introduced through the opening 30 into the pressure chamber 31. The pressures quickly balance and partially dispensed product in the dispensing nozzle 26 together with air in the dispensing nozzle 26 is not drawn back or sucked back through the dispensing passageway 29 into the flexible bag 23. This is an important feature, particularly when the product within the flexible bag 23 is subject to oxidation. Furthermore, by balancing the air pressures and introducing additional air to the pressure chamber 31, the flexible bag 23 remains in a partially collapsed position and is ready for immediate dispensing upon another manual squeezing of the outer flexible container 21. In this manner, essentially all of the product within the flexible bag 23 may be removed. If a sterile product is involved, the used bag 23 may then be removed and replaced with a new product bag 23. The disposal problems created by the used bag 23 are minimal compared to many prior art container structures.

Referring to FIGS. 4–7, another fluid product dispenser, according to the present invention, is generally indicated by the reference number 35. The fluid product dispenser 35 includes an outer flexible container 36, constructed of a flexible plastic material, an inner container or flexible bag 37 and a semi-flexible cap assembly 38. The outer container 36 includes a neck portion 39 which receives a depending shoulder 40 of the cap assembly 38. A pressure chamber 49 is defined between the outer flexible container 36 and the inner flexible bag 37. The cap assembly 38 defines a pressure passageway or opening 41 and a product dispensing opening 42.

Figure 6:
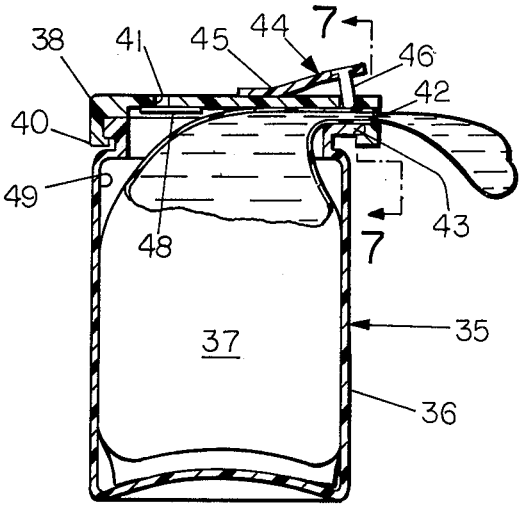
FIG. 6 is a vertical sectional view, similar to FIG. 5, showing product being dispensed.
Figure 7:
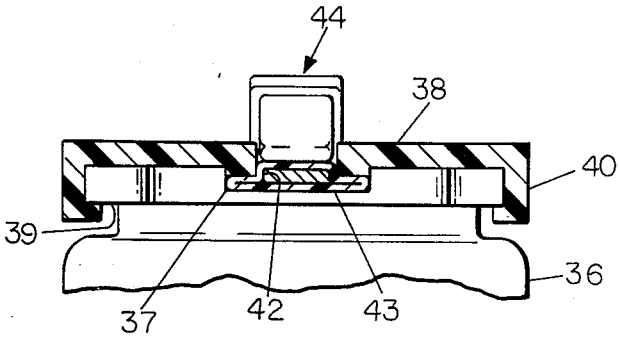
FIG. 7 is a fragmentary, enlarged sectional view taken along the line 7—7 of FIG. 6.

Referring to FIGS. 6 and 7, an upper open end 43 of the flexible bag 37 is adjacent the product dispensing opening 42. A product dispensing valve assembly 44 includes a resilient arm 45 which is connected at one end to the upper surface of the semi-flexible cap assembly 38. The other end of the arm 45 mounts a valve bar 46. The valve bar 46 extends through a complementary opening 47 provided in the cap assembly 38 and normally presses the open end 43 of the flexible bag 37 into a closed position, as shown in FIG. 5.

Figure 5:
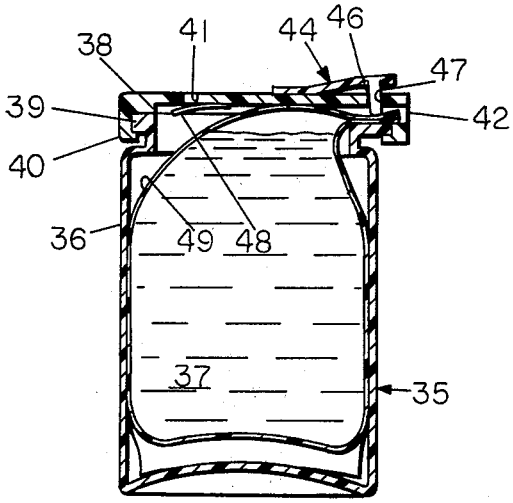
FIG. 5 is a vertical sectional view of the FIG. 4 product dispenser.

Referring to FIGS. 5 and 6, a check valve or flap valve 48 is connected to the bottom of the cap assembly 38 in a complementary relationship with the opening 41.

In normal operation, a fluid product is placed within the flexible bag 37. The check valve 48 admits air through the opening 47 into the pressure chamber 49 defined between the outer surface of the flexible bag 37 and the inner surface of the flexible outer container 36. To dispense the fluid product, the valve bar 46 is moved to its open position, as shown in FIGS. 6 and 7, and the outer container 36 is squeezed. This closes the check valve 48 and a generally uniform pressure is applied to the flexible bag 37. Product is then forced through the opening 42. When sufficient product has been dispensed, the product valve assembly 44 is closed. The outer container 36, upon release, begins to assume its FIG. 5 position and the flap valve 48 opens, admitting air to the pressure chamber 49. As with the FIG. 1 embodiment, suck-back is eliminated and the flexible bag 37 remains partially collapsed, awaiting the next use of the fluid product dispenser 35.

If desired, two flexible bags (not shown) may be placed in the outer container 36 and two product dispensing openings and valves provided, each in communication with a respective bag. In this embodiment (not shown) the two bags may be filled with, for examples, mustard and catsup, for use in restaurants. As an individual flexible bag becomes exhausted, a new bag filled with product is substituted for the exhausted bag.

Figure 8:
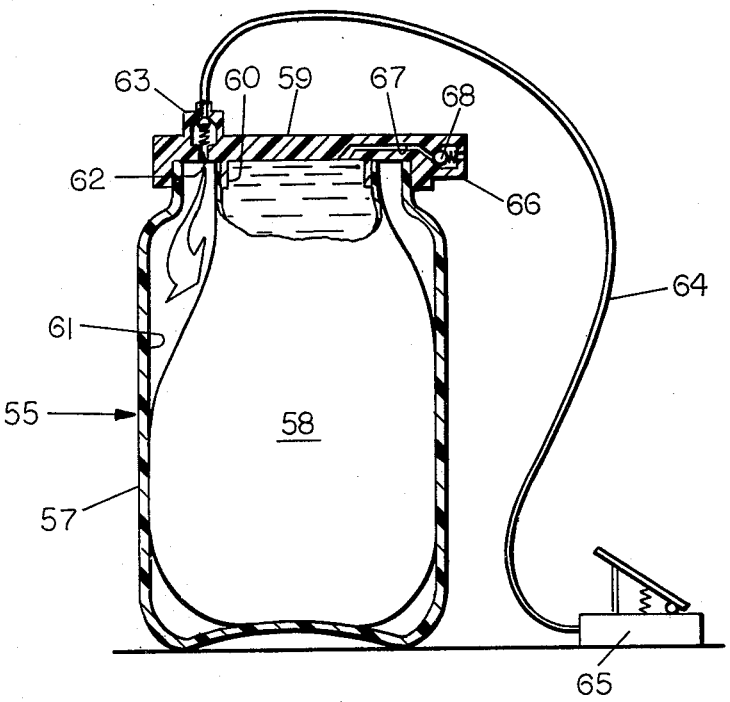
FIG. 8 is a vertical sectional view of another embodiment of a fluid product dispenser, according to the present invention.
Figure 9:
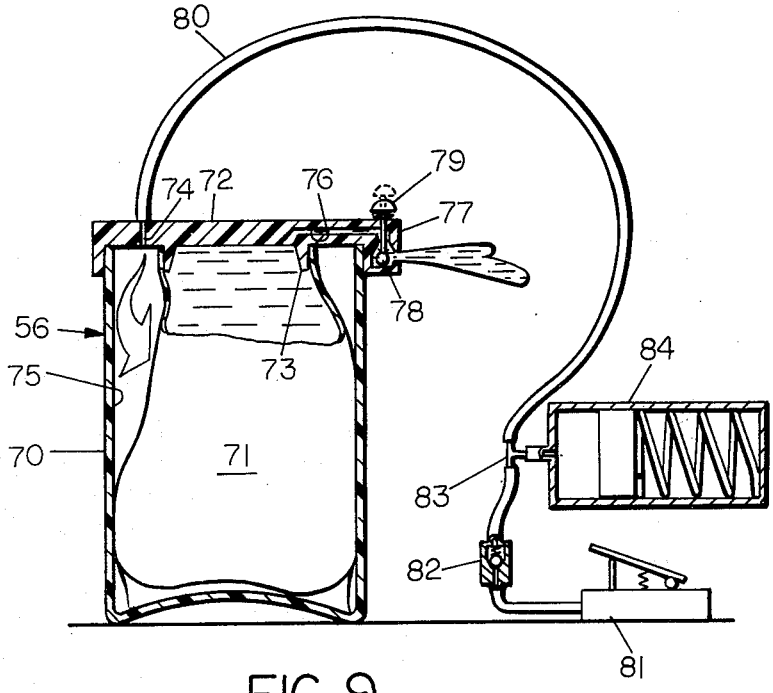
FIG. 9 is a vertical sectional view of still another embodiment of a fluid product dispenser, according to the present invention, disclosing the use of an accumulator apparatus in connection with a remote pump means.
Figure 10:
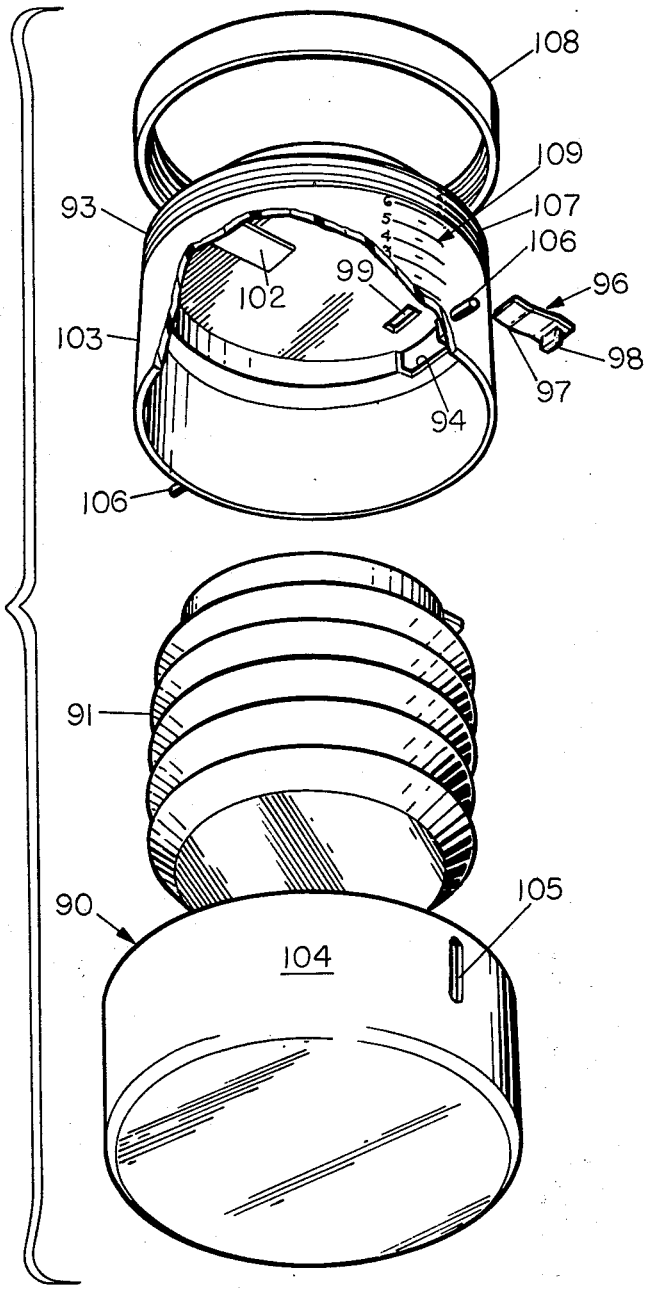
FIG. 10 is an exploded view of another embodiment of a fluid product dispenser, according to the present invention.

Referring to FIGS. 8 and 9, two additional embodiments of fluid product dispensers, according to the present invention, are generally indicated by the reference numbers 55 and 56. The product dispensers 55 and 56 are more adaptable to an industrial or commercial use, as opposed to a restaurant, hospital or home use. For example, the product dispensers 55 and 56 may be used to dispense oils, chemical solutions or the like.

Referring to FIG. 8, the fluid product dispenser 55 includes a rigid outer container 57, a flexible inner container 58 and a top 59 mounted on the upper end of the rigid outer container 57. The top 59 includes a depending shoulder 60 which mounts the flexible inner container 58. The containers 57 and 58 define a pressure chamber 61 which is in communication with a passageway 62 defined by the top 59. A ball-type spring-biased check valve 63 is mounted in the top 59 adjacent the passageway 62 and is in communication with a conduit 64 and a foot-operated pump 65. Other types of pump means may be utilized, for examples, a small compressor or a factory source of compressed air. The check valve 63 allows the passage of pressurized fluid through the conduit 64 into the pressure chamber 61, but prevents reverse flow from the pressure chamber 61. The top 59 also defines a dispensing nozzle 66 which is in communication with the interior of the flexible inner container 58 through a dispensing passageway 67. In operation, a fluid is placed in the flexible inner container 58. To dispense the product, the foot pump 65 is operated, forcing air past the check valve 63 and pressurizing the pressure chamber 61. This applies a generally uniform pressure force to the flexible inner container 58 and the product is urged outwardly through the dispensing passageway 67; through a second ball check valve 68 positioned within the passageway; and through the dispensing nozzle 66. When the operator wishes to stop the product flow, he stops operation of the pump 65 and the pressure within the conduit 64 decreases. The pressure differential closes the check valve 63 and the product flow stops. The ball check valve 68 in the dispensing passageway 67 prevents a reverse flow of partially dispensed product or air from entering the flexible inner container 58.

The fluid product dispenser 56, shown in FIG. 9, is quite similar in construction to the FIG. 8 embodiment. The dispenser 56 includes a rigid outer container 70, a flexible inner container 71 and a top 72. In the dispensers 55 and 56, the respective outer containers 57 and 70 may be constructed of plastic, glass or metal, all well known in the art. The top 72 includes a depending shoulder 73 for supporting the open upper end of the flexible inner container 71 and defines a passageway 74 in communication with a pressure chamber 75 defined between the rigid outer container 70 and the flexible inner container 71. The top 72 also defines a dispensing passageway 76 and a dispensing nozzle 77. A spring-biased check valve 78 having an operating rod 79 is positioned in the dispensing nozzle 77 in communication with the dispensing passageway 76. A conduit 80 is in communication with the passageway 74 leading to the pressure chamber 75. The other end of the conduit 80 is connected to a foot-operated pump 81. Again, many types of pump means may be utilized.

A spring-biased ball check valve assembly 82 is positioned adjacent the pump 81 and a tee fitting 83 in the conduit 80 is in communication with a piston-type accumulator 84. In operation, the pump 81 forces air or other fluid through the check valve 82, the fitting 83, and the remainder of the conduit 80 into the pressure chamber 75. At the same time, the accumulator 84 is also being loaded. When the operating rod 79 is moved vertically downward, as indicated by the arrow in FIG. 9, the check valve 78 is opened and the product dispensed from the inner flexible container 71, through the dispensing passageway 76 and downwardly through the dispensing nozzle 77. When the operating rod 79 is released, the spring-biased check valve 78 is closed and product flow stops. As is well known in the art, the accumulator 84 provides sufficient pressure to dispense product several times before it is necessary to reload the accumulator 84 by the use of the pumping means 81.

Figure 11:
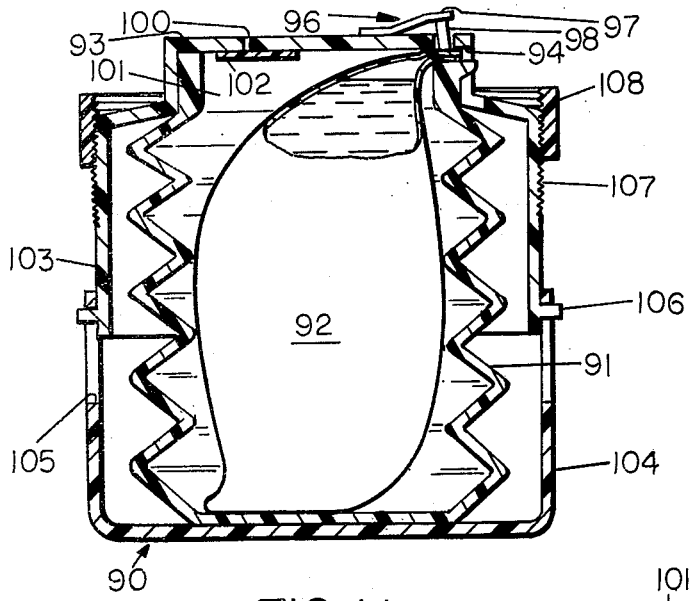
FIG. 11 is a vertical sectional view of the FIG. 10 dispenser.

Referring to FIGS. 10–13, another fluid product dispenser, according to the present invention, is generally indicated by the reference number 90. The dispenser 90 is particularly adaptable for the dispensing of medicinal products where it is desired to dispense a predetermined accurate amount of product upon each operation of the dispenser. The fluid product dispenser 90 includes an outer container 91 constructed of relatively flexible material and having a bellows configuration. A flexible inner container or bag 92 is positioned within the bellows container 91. A top 93 receives the upper portion of the bellows container 91, and the top 93 and container 91 mutually define a dispensing nozzle or opening 94. An upper open end 95 of the flexible bag 92 is positioned within the dispensing opening 94 and is in cooperating relationship with a product dispensing valve assembly 96. The valve assembly 96 includes an arm 97 connected to the upper surface of the top 93. The outer end of the arm 97 mounts a valve bar 98, which is positioned within an opening 99 defined by the top 93. The arm 97 urges the valve bar 98 downwardly into a tight engaging relationship with the upper end 95 of the flexible bag 92, to retain such end 95 in a normally closed position, as shown in FIG. 11. The top 93 defines a fluid passageway 100 which communicates with a pressure chamber 101 defined between the bellows container 91 and the flexible bag 92. A check valve or flap valve 102 is mounted on the bottom of the top 93 in cooperating relationship with the fluid passageway 100. The check valve 102 allows atmospheric air to enter the pressure chamber 101 but prevents air or other fluid from leaving the chamber 101 through the fluid passageway 100.

In the present embodiment, the top 93 includes a depending sidewall 103 which is received by and telescopes with a cup-shaped base 104. The base 104 defines a pair of vertical guide slots 105 which receive complementary projections 106 which extend outwardly adjacent the lower edge of the depending sidewall 103 of the top 93. The upper end of the cap sidewall 103 defines a plurality of threads 107 which receive an internally threaded adjusting ring 108.

Figure 12:
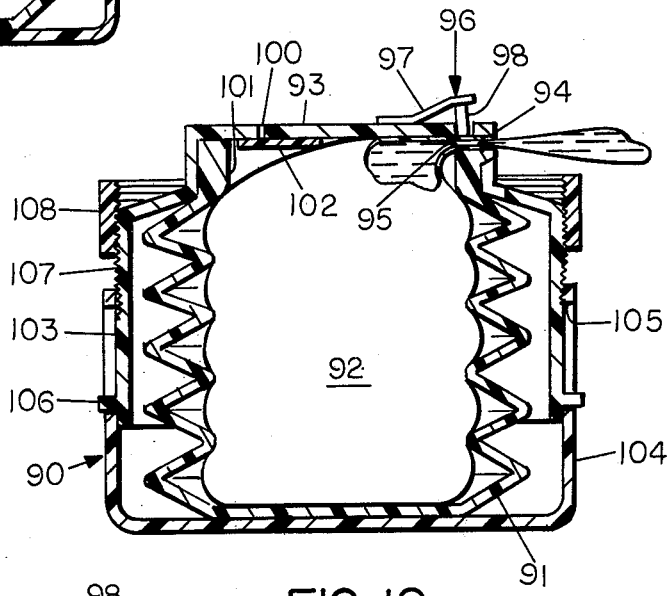
FIG. 12 is a vertical sectional view, similar to FIG. 11, showing the upper portion of the dispenser being moved downwardly during the product dispensing operation.
Figure 13:
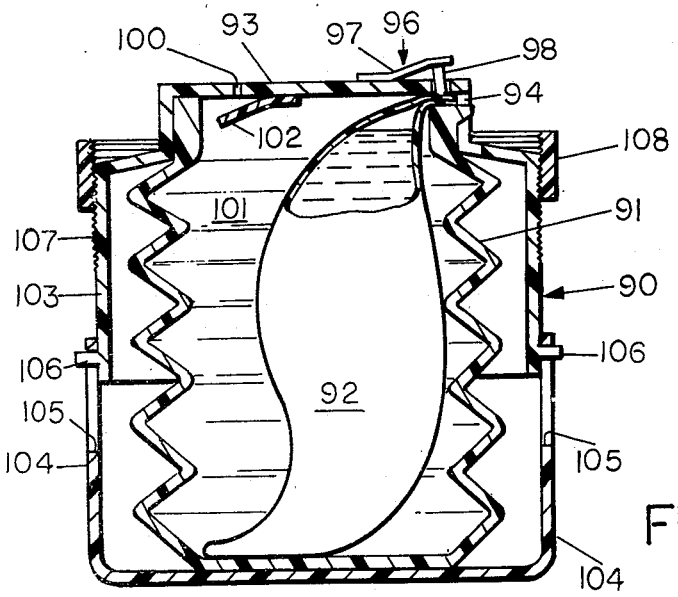
FIG. 13 is a view similar to FIG. 12, showing the fluid product dispenser as it moves upwardly to the FIG. 11 position.

In the operation of the fluid product dispenser 90, the product, for example a medicinal, is placed within the inner container or flexible bag 92. The valve bar 98 is raised so that product may be dispensed through the dispensing opening 94. Fluid, in this case air, has entered from atmosphere into the pressure chamber 101 through the fluid passageway 100 in the top 93. The top 93 is then pushed downwardly, as shown in FIG. 12, until the bottom of the adjusting ring 108 strikes the upper surface of the cup-shaped base 104. During the downward travel, the outer or bellows container 91 compresses and the flap valve 102 remains closed, placing a relatively uniform force on the outer surface of the flexible bag 92 and dispensing a predetermined amount of product through the dispensing opening 94.

The amount of product dispensed each time may be controlled to change the predetermined dosage. This is done by vertically adjusting the ring 108 which controls the relative vertical movement between the adjusting ring 108 and the upper surface of the cup-shaped base 104. Preferably, indicia, generally indicated by the reference number 109 (see FIG. 10), is placed on the outer surface of the depending side-wall 103 to indicate the predetermined dosage.

Figure 14:
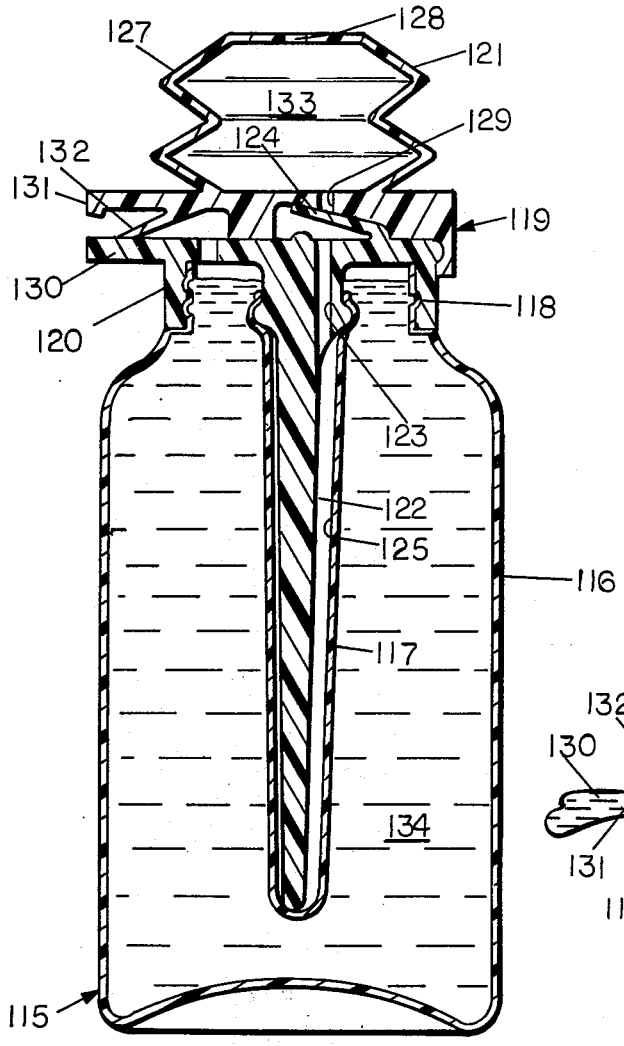
FIG. 14 is a vertical sectional view of still another embodiment of a fluid product dispenser, according to the present invention.
Figure 15:
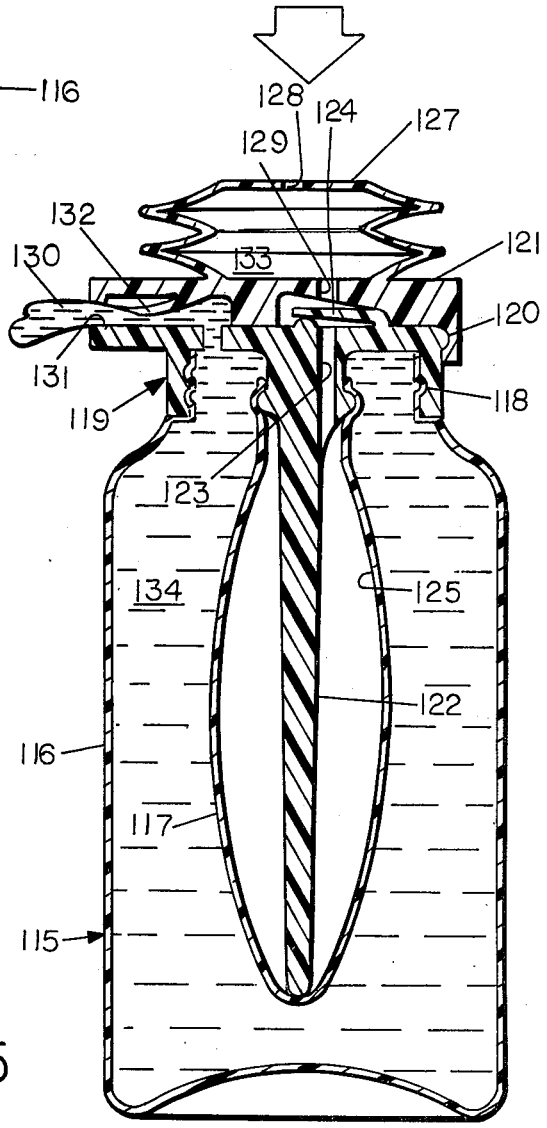
FIG. 15 is a vertical sectional view of the FIG. 14 dispenser, showing the dispenser as the product is dispensed.
Figure 16:
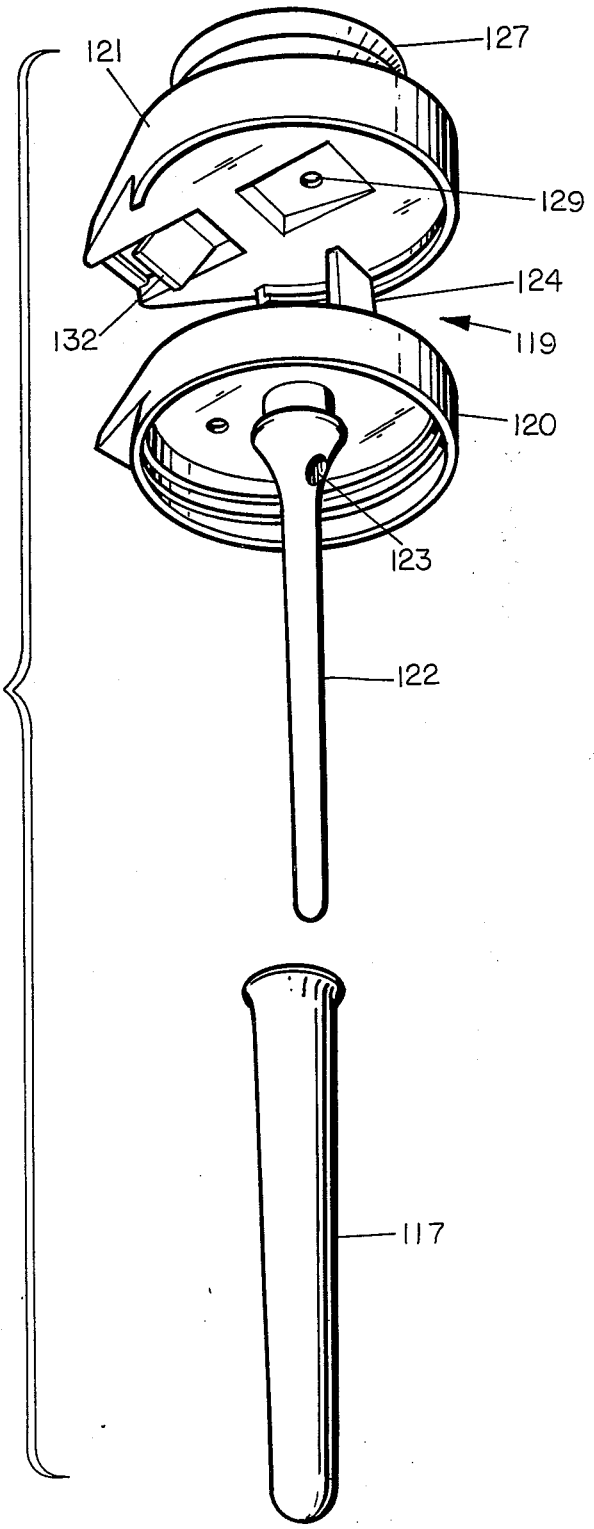
FIG. 16 is an exploded view showing central portions of the FIG. 14 dispenser.

Another fluid product dispenser, according to the present invention, is generally indicated in FIGS. 14 and 15 by the reference number 115. The dispenser 115 is particularly adaptable to supermarket shelf items, such as mustard, catsup, etc. The dispenser 115 includes an outer rigid container 116, which may be, for example, a finish glass container. An inner container 117 is positioned within the outer container 116 and comprises an elastomeric flexible member, for example, a balloon-like member. The outer container 116 includes a threaded neck 118 and a cap assembly 119 having mating threads, and is mounted on the container 116. The cap assembly 119, in the present embodiment, is a two-piece assembly including a nozzle portion 120 and a pump portion 121. The nozzle portion 120 includes a depending fluid nozzle 122 which mounts the flexible balloon member 117. The fluid nozzle 122 defines a fluid passageway 123 and has an upwardly biased check valve or flap valve 124 on its upper surface. A pressure chamber 125 is defined by the interior of the flexible balloon member 117.

The pump portion 121 of the cap assembly 119 mates with the nozzle portion 120 and includes a pump bellows 127. An air intake opening 128 is provided on the upper surface of the pump bellows 127. The pump portion 121 also defines a fluid passageway 129, in communication with the fluid passageway 123 of the fluid nozzle 122. The flap valve 124 is in a complementary relationship with the fluid passageway 129, allowing fluid to enter the fluid nozzle 122 through the fluid passageway 129, but preventing reverse flow from the pressure chamber 125 through the fluid passageway 129.

In this embodiment, the nozzle portion 120 and the pump portion 121 of the overall cap assembly 119 mutually define a dispensing nozzle 130 having a dispensing opening 131. A product dispensing check valve 132 is positioned within the dispensing nozzle 130.

The product is placed within the rigid outer container 116. To dispense product, the operator closes the air intake opening 128 with his finger or hand during a vertically downward stroke, as indicated by the arrow in FIG. 15. This forces air downwardly through the fluid passageway 129 and the communicating fluid passageway 123. The air pressure opens the check valve 124. As the pump bellows 127 returns to the FIG. 14 position, additional air is supplied to a pump chamber 133 defined by the interior of the pump bellows 127. The check valve 124 is biased against the fluid passageway 129 during this return stroke.

During a downward stroke, the pressure chamber 125 is expanded with the flexible walls of the inner or balloon member 117 moving outwardly, thereby exerting pressure forces on the product. This forces the product outwardly through the product dispensing check valve 132, the dispensing nozzle 130 and the dispensing opening 131, as indicated in FIG. 15. The check valve 132 prevents air or partially dispensed product from re-entering or entering a product chamber 134 defined between the rigid outer container 116 and the flexible balloon member 117. After the product has been dispensed from the product chamber 134, the cap assembly 119 and inner flexible balloon member 117 may be removed as a unit and cleaned for reuse. The unit may then be placed on either a new product containing container 116 or the container 116 may also be cleaned and refilled.

It has been found that a fluid product dispenser, according to the present invention, solves many of the problems found in prior art dispensers and provides an efficient, sanitary and ecological dispenser.

What I claim is:

1. A fluid product dispenser comprising, in combination, a rigid first container, a second container positioned within said first container, said second container comprising a flexible bag for receiving a fluid product, a cap removably mounted on said first container, a product dispensing means defined by said cap and in communication with said second container for dispensing the fluid product located in said second container, said first container and said second container defining therebetween a pressure chamber, and means in communication with such chamber for introducing pressurized fluid into such chamber whereby a force may be transmitted to said second container urging the fluid product outwardly through said product dispensing means, said product dispensing means including a check valve means for preventing reverse flow.

2. A fluid product dispenser, according to claim 1, wherein said introducing fluid means includes a passageway from the exterior of the dispenser to said chamber, a conduit, one end of which is in communication with said passageway, and a remote source of pressurized fluid connected to the other end of said conduit for supplying a pressurized fluid to said pressure chamber.

3. A fluid product dispenser, according to claim 2, wherein said introducing fluid means includes a fluid check valve means for preventing fluid flow from such pressure chamber.

4. A fluid product dispenser, according to claim 2, wherein said remote source of pressurized fluid includes pump means for supplying a pressurized fluid through said conduit and said passageway to such pressure chamber.

* * * * *